US011591207B2

(12) United States Patent
Yousfi et al.

(10) Patent No.: US 11,591,207 B2
(45) Date of Patent: Feb. 28, 2023

(54) FLUID TRANSFER LINE WITH ELECTRIC ACTUATORS AND BRAKING MEANS FOR EACH ACTUATOR

(71) Applicant: FMC Technologies, Sens (FR)

(72) Inventors: Karim Yousfi, Paron (FR); Adrien Vannesson, Sens (FR); Pierre-Eric Bauwens, Villeroy (FR)

( * ) Notice: Subject to any disclaimer, the term of this patent is extended or adjusted under 35 U.S.C. 154(b) by 16 days.

(21) Appl. No.: 16/492,275

(22) PCT Filed: Mar. 30, 2018

(86) PCT No.: PCT/EP2018/058354
§ 371 (c)(1),
(2) Date: Sep. 9, 2019

(87) PCT Pub. No.: WO2018/178368
PCT Pub. Date: Oct. 4, 2018

(65) Prior Publication Data

US 2021/0147216 A1 May 20, 2021

(30) Foreign Application Priority Data

Mar. 31, 2017 (FR) ..... 1752823

(51) Int. Cl.
*B67D 9/02* (2010.01)
*B63B 27/24* (2006.01)
(Continued)

(52) U.S. Cl.
CPC ..... *B67D 9/02* (2013.01); *B63B 27/24* (2013.01); *B63B 27/34* (2013.01); *B67D 7/0401* (2013.01); *B67D 2210/00047* (2013.01)

(58) Field of Classification Search
CPC .. B67D 9/00; B67D 9/02; B63B 27/24; B63B 27/25; B63B 27/344
See application file for complete search history.

(56) References Cited

U.S. PATENT DOCUMENTS 4,168,611 A * 9/1979 Woyton ..... H02P 29/0022 60/413
4,231,398 A 11/1980 Gibbons
(Continued)

FOREIGN PATENT DOCUMENTS

EP 2 543 624 A1 1/2013
JP 2007-078015 A 3/2007
(Continued)

OTHER PUBLICATIONS

Japanese Patent Office, Notice of Reasons for Rejection issued in connection with Japanese Patent Application No. 2019-553312 dated Nov. 19, 2021.

*Primary Examiner* — Jason K Niesz

(57) ABSTRACT

The system (10) for the transfer of fluid comprises a tubular fluid transfer line (2) comprising at one of its ends a coupling system (32) adapted to be connected to a target duct (33) for the transfer of fluid, and electrical actuators (11-13) for controlling the movement of the transfer line in space, each via an actuating shaft, characterized in that each of the actuators for controlling the movement of the transfer line comprises an electric motor with an output shaft, a speed reducer, the actuating shaft being rotationally driven by the motor output shaft by means of the speed reducer, which is reversible, so as to enable the actuating shaft to turn when an actuating torque is directly applied to it, and braking means for locking the actuator in position when movement control is in course and that actuator is not activated for that control.

5 Claims, 6 Drawing Sheets

(51) Int. Cl.
*B63B 27/34* (2006.01)
*B67D 7/04* (2010.01)

(56) References Cited

U.S. PATENT DOCUMENTS 4,318,465 A * 3/1982 Calvert ..... B23Q 16/025 198/341.02
4,406,340 A * 9/1983 Gennaux ..... H02K 7/102 180/60
4,408,943 A * 10/1983 McTamaney ..... B63B 27/24 114/74 R
5,944,448 A * 8/1999 Williams ..... B63B 27/24 405/169
7,147,022 B2 12/2006 Le Devehat
7,699,359 B2 * 4/2010 Le Devehat ..... F16L 37/1205 285/364
7,954,512 B2 6/2011 Le Devehat
8,393,362 B1 3/2013 Hollerback
9,403,669 B2 8/2016 Fusy
9,815,530 B2 11/2017 Fusy
10,081,414 B2 9/2018 Le Devehat et al.
2009/0065078 A1 * 3/2009 Le Devehat ..... B67D 9/02 137/615
2009/0293969 A1 12/2009 Le Devehat et al.
2010/0313977 A1 * 12/2010 Sylard ..... B67D 9/00 141/279
2011/0066290 A1 * 3/2011 Le Devehat ..... B63B 27/34 700/279

FOREIGN PATENT DOCUMENTS

JP 2007-196968 A 8/2007
JP 2008-043164 A 2/2008
JP 2016-003754 A 1/2016
WO WO 2009/098540 A2 8/2009
WO WO 2015/126320 A1 8/2015

* cited by examiner

Fig.3a
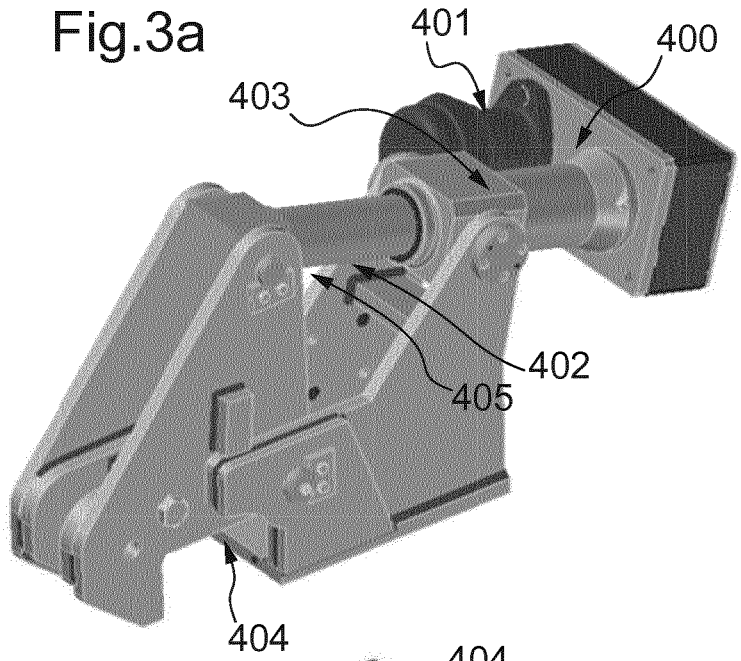
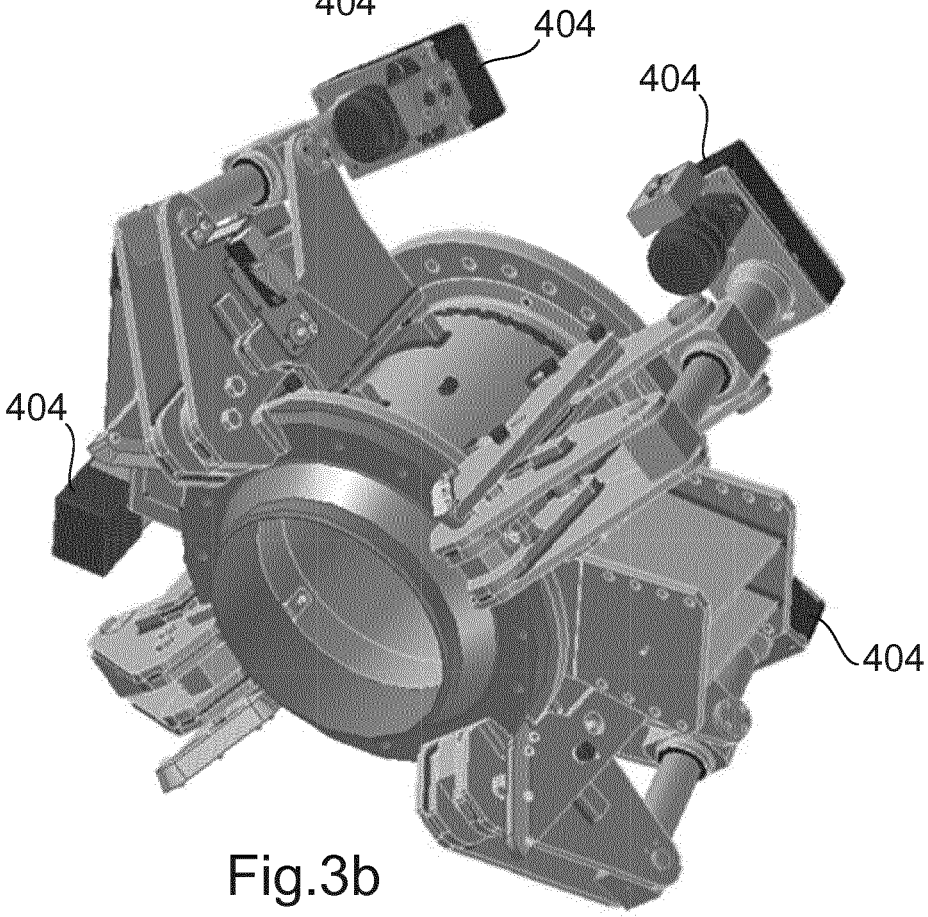
Fig.3b

FLUID TRANSFER LINE WITH ELECTRIC ACTUATORS AND BRAKING MEANS FOR EACH ACTUATOR

The present invention generally relates to fluid transfer systems, and more particularly marine loading systems, in particular such as articulated loading arms for the transfer of a fluid from one location to another (loading and/or unloading).

Fluid is understood herein to mean a liquid or gaseous product, such as a petroleum, gas or chemical product.

This type of product is to be transferred, for example, between a ship and a quay or jetty or between two ships. In practice, the transfer system is thus fastened to the ground, on a vehicle or a marine vessel.

For marine loading systems, this may be:

Conventional marine loading arms such as defined for example in the patent applications FR2813872, FR2854156, and FR2931451;

Marine loading arms without a base that enable low connection points to be reached such as defined for example in patent application FR2964093;

Bunkering or hybrid loading arms (a rigid part and a flexible part), such as defined for example in patent application FR3003855.

These marine loading systems may operate with electrical actuators.

The use of such actuators has already been provided in the aforementioned patent application FR2931451.

When the coupler of the loading arm described in this patent application FR2931451 is connected to a target duct, a computer sends all the actuators a disengage instruction so as to make the movements of the system free to enable the coupler to follow the movements of the target duct ("free wheel" mode).

This has the advantage of not having to guide the arm actively in order to make it follow the movements of the structures carrying the arm and the target duct and, thereby, in order not to consume electricity during the transfer phase.

In the case of an electrical actuator, the disengagement results in the necessity to implement a clutch between the reducer and the actuating cog of the actuator, to the detriment of the compactness of that actuator.

The present invention is more particularly directed to eliminating this drawback. It is more generally directed to an entirely electrical fluid transfer system, with improved performance.

To that end the present invention provides a system for the transfer of fluid from a storage position to a target duct or from that target duct to the storage position, the system comprising a tubular fluid transfer line comprising at one of its ends a coupling system adapted to be connected to the target duct for the transfer of fluid, and electrical actuators for controlling the movement of the transfer line in space, each via an actuating shaft, characterized in that each of the actuators for controlling the movement of the transfer line comprises an electric motor with an output shaft, a speed reducer, the actuating shaft being rotationally driven by the motor output shaft by means of the speed reducer, which is reversible, so as to enable the actuating shaft to turn when an actuating torque is directly applied to it, and braking means for locking the actuator in position when movement control is in course and that actuator is not activated for that control.

Contrary to every expectation, reversible speed reducers available on the market proved to be able to operate in reversible mode with the very high reduction ratios required in the field of the fluid transfer systems with a tubular transfer line (of which there may be up to 700 in practice) and, thereby, enable the objective sought of compactness to be attained, with acceptable reversibility torques.

Furthermore, the resulting actuator requires little maintenance. It already requires less than a conventional hydraulic actuator and the absence of a clutch further reduces this need for maintenance.

The aforesaid provisions moreover make it possible to attain other objectives, when desired.

In particular, the reversibility of the actuator can, in free wheel mode, enable current to be produced, by operating as a current generator. A fluid transfer system results from this which is particularly economical since, in free wheel mode, this not only does not consume energy but produces it. This actuator can also act in current generator mode in case of braking of the arm in particular at the time of emergency release.

The present invention also provides an articulated arm for fluid transfer comprising a transfer system as defined above, the transfer system comprising articulated piping mounted on a support having three degrees of rotational freedom in space relative to the support, the movements in each of the degrees of freedom being controlled by at least one of the electrical actuators for controlling movement of the transfer line in space.

Still other particularities and advantages of the invention will appear in the following description.

BRIEF DESCRIPTION OF THE DRAWINGS

In the accompanying drawings, given by way of non-limiting example:

FIG. 3*a* illustrates a perspective view of a branch of the coupler according to the first embodiment of the invention;

FIG. 3*b* illustrates a perspective view of the coupler illustrated earlier in mounting position;

DETAILED DESCRIPTION

Figure 1:
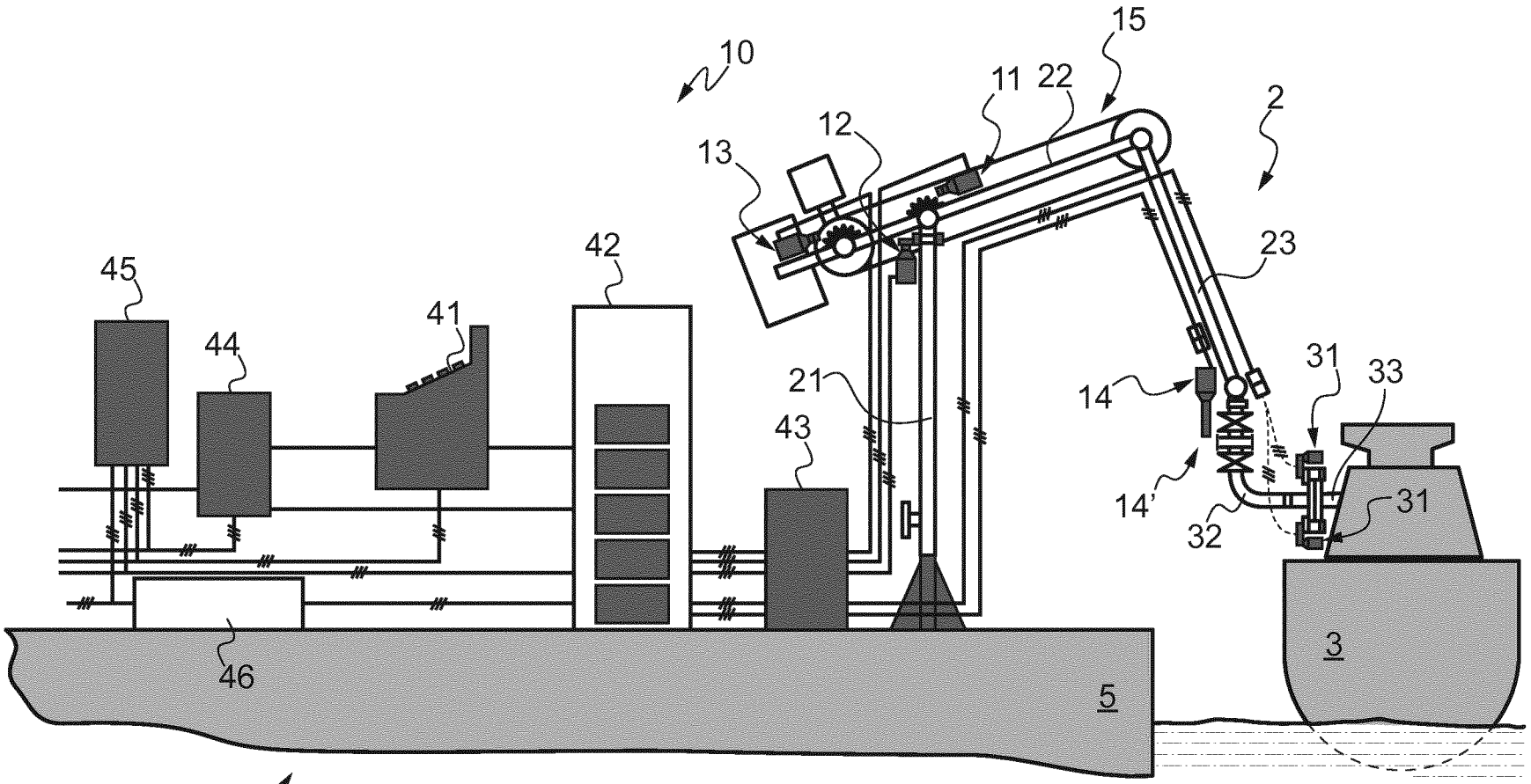
FIG. 1 is a synoptic diagram of an articulated arm for fluid transfer on a quay with installation of the electrical part according to a first embodiment.

A description will now be made with reference to FIG. 1 of an example of a system for the transfer of fluid 10 from a storage position to a target duct 33 located on a ship 3 and from that target duct 33 to the storage position, the fluid transfer system 10 comprising a fluid transfer line comprising at one of its ends a coupler 31 of "QCDC" type, this standing for "Quick Connect Disconnect Coupling", which is configured to be connected to the target duct 33 for the transfer of fluid, and electrical actuators 11,12,13 for controlling the movement of the transfer line in space, each via an actuating shaft.

Here, the system for the transfer of fluid 10 is a marine loading arm.

Furthermore, the fluid transfer system 10 is linked to a reservoir for the fluid not shown in the Figures.

It follows that the fluid transfer system 10 comprises an electrical structure and a mechanical structure.

The mechanical structure comprises a fluid flow structure and a manipulation structure. The electrical structure will be described later in the description.

The manipulation structure comprises a base 21, an inner tube 22, an outer tube 23 and a coupling system 32, together forming an articulated arm 2.

The articulated arm 2 here is an articulated arm balanced by means of counterweights 19*a* and 19*b*, in particular by means of a counterweight 19*a* disposed at one end of the inner tube 22 and another counterweight 19*b* disposed on the pantograph 15.

The base 21 is fixed to the jetty 5. The base 21 could also have been fixed to a vehicle or to a marine vessel.

The inner tube 22 is connected by a first end to the base 21 and by a second end to a first end of the outer tube 23 via a swivel joint. The outer tube 23 is connected by a second end to a first end of the coupling system 32 via a swivel joint.

The maneuvering electrical actuators 11, 12, 13 enable the fluid transfer system to be articulated.

Indeed, the fluid transfer system is actuated in particular by a pantograph system 15. The pantograph system 15 is typically situated above the base 21, on the inner tube 22.

The rotation around a vertical axis of the compass formed by the tubes 22 and 23 is controlled by the rotation of the maneuvering electrical actuator 12.

The actuation of the pantograph 15 is controlled by the rotation of the second maneuvering electrical actuator 13 and enables the outside tube 23 to be extended.

Furthermore, the rotation of the inside tube 22 around a horizontal axis, parallel to the horizontal rotational axis of the outside tube 23, is provided by means of the maneuvering electrical actuator 11.

Furthermore, the coupling system 32 comprises an electrical actuator 14 for an Emergency Release System 14' (or "ERS"). The Emergency Release System 14' as is known per se comprises two valves coupled using a collar with opening controlled by at least the electrical actuator 14.

The coupling system 32 in practice has three swivel joints denoted 32*a*, 32*b* and 32*c* and is equipped with the coupler 31 at its free end and also comprises the Emergency Release System 14'.

The Emergency Release System 14' is located between the swivel joint 32*b* and the swivel joint 32*c*

Furthermore, the coupler 32 comprises four coupler electrical actuators 31*a*, 31*b*, 31*c*, 31*d* (see description of FIGS. 3*a*-3*d* further on)

The complete mechanical structure is disposed here in an ATEX zone. ATEX derives its name from the French title of the 94/9/EC directive: Appareils destinés à être utilisés en ATmosphères EXplosives The electrical structure is shared between two zones: the ATEX zone and a secure area.

The ATEX zone then corresponds to a zone with an explosive atmosphere. In this atmosphere, there is a mixture of air and inflammable substances in the form of gas, vapor or dust. This atmosphere presents a risk of explosion in the presence of sparks or excessive heating up. The structure electrical must therefore be arranged to avoid the formation of electrical arcs in the ATEX zone.

This is why, in the ATEX zone, certain devices are electrically insulated to avoid electrical arcs, during the connection phase, due to an excessive potential difference between the target duct 33 of the ship 3 and the coupling system 32.

On the other hand, a secure area is a zone not in principle having an atmosphere with a risk of explosion.

In the ATEX zone are situated the mechanical structure provided with the electrical actuators 11, 12, 13, 14, 31*a*, 31*b*, 31*c*, 31*d*.

Still in the ATEX zone is also an electrical cabinet 43 establishing the link between a control cabinet 42 and the electrical actuators 11, 12, 13, 14, 31*a*, 31*b*, 31*c*, 31*d*.

The electrical cabinet 43 is an explosion-resistant cabinet containing connection terminals. It has an envelope designated "Ex d". This means that the envelope withstands the pressure developed in an internal explosion of an explosive mixture and thereby prevents the transmission of the explosion to the atmosphere surrounding the envelope.

As a variant, the electrical cabinet 43 is a cabinet having an envelope designated "Ex e". This means that the envelope has enhanced safety.

In the ATEX zone there is also a control cabinet 42. The control cabinet 42 comprises one controller per electrical actuator (in practice a drive). The control cabinet 42 is supplied via an insulating transformer 46 and communicates with the control console 41. Furthermore, the control cabinet 42 sends information to the electrical actuators 11, 12, 13,14, 31*a*, 31*b*, 31*c*, 31*d* via the electrical cabinet 43.

The control cabinet 42 has an envelope designated "Ex p". This means that the surrounding atmosphere is prevented from entering inside the envelope of the control cabinet 42 by maintaining inside the envelope a protective gas at a pressure greater than that of the surrounding atmosphere.

In the ATEX zone is also the control console LCP 41 thanks to which the operator can send settings to the electrical actuators 11, 12, 13,14, 31*a*, 31*b*, 31*c*, 31*d*. The control console LCP 41 is also protected.

In the secure area is a PLC 44 (PLC standing for Programmable Logic Controller) and an emergency power supply 45.

The emergency power supply 45 is operative when the main supply is no longer able to provide the electricity supply, in particular the electrical supply for the electrical actuators 11, 12, 13,14, 31*a*, 31*b*, 31*c*, 31*d*. The emergency power supply 45 makes it possible to maneuver the electrical actuators 11, 12, 13,14, 31*a*, 31*b*, 31*c*, 31*d* over a short period enabling the emergency release accompanied by the emergency retraction over a few meters and possibly the full retraction of the articulated arm 2.

A description will now be given with reference to FIG. 2, of an electrical actuator 200 comprising an electric motor 201 with an output shaft not shown, a speed reducer 202, the actuating shaft 205 being rotationally driven by the motor output shaft by means of the speed reducer 202, which is reversible, so as to enable the actuating shaft 205 to turn when an actuating torque is directly applied to it, and a brake not shown to lock the electrical actuator 200 in position when a movement command is in course and that electrical actuator 200 has not been activated for that command.

Figure 2:
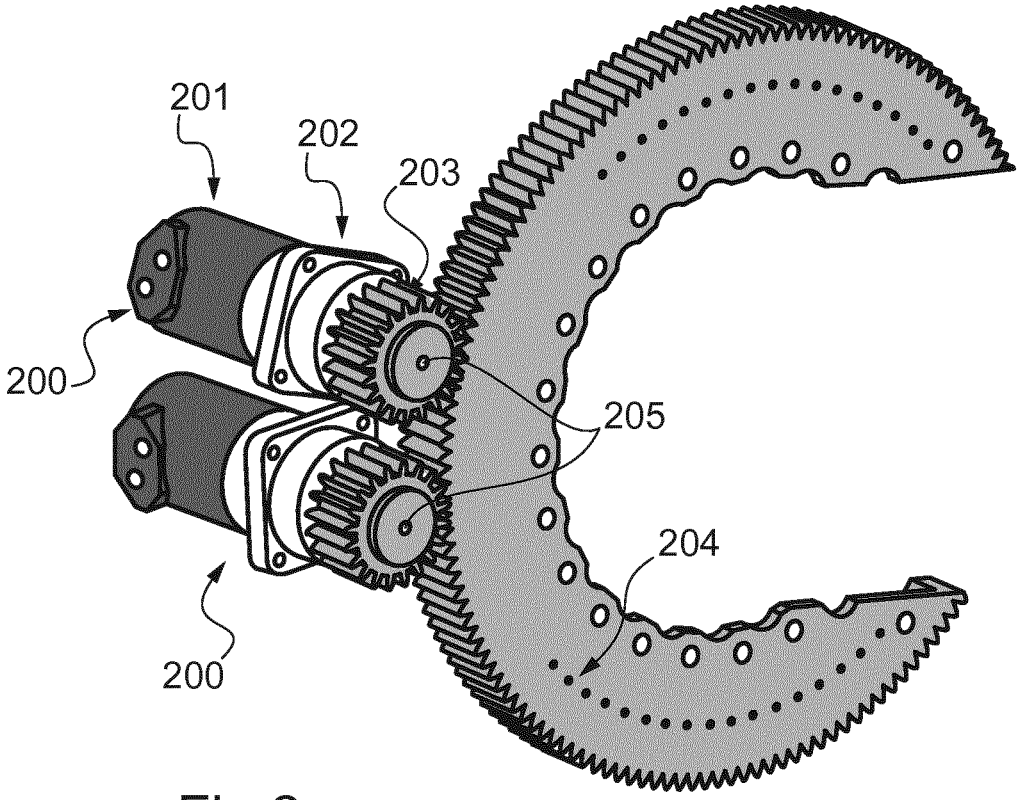
FIG. 2 illustrates a perspective view of two electrical actuators driving a toothed wheel according to the first embodiment.

Furthermore, FIG. 2 represents more specifically two electrical actuators 200 each driving a segmented toothed wheel 204 via a cog 203 joined to the actuating shaft 205. Generally, a single electrical actuator 200 is able to drive a toothed wheel 204. However, when a single electrical actuator 200 does not have enough power to rotationally drive a toothed wheel, two electrical actuators 204 may be mounted.

In practice, the reduction ratio obtained with the speed reducer 202 lies between 25 and 700 for the electrical actuator 200. These are non-limiting values. It is necessary to add the ratio between the toothed wheel 204 and the cog 203 which may vary between 2 and 20.

The electric motor 201 employed here is a brushless motor.

The speed reducer 202 is a reducer with an epicyclic gear train. Such a speed reducer 202 is able to operate reversibly since little friction is produced and the efficiency of the speed reducer 202 is high, of the order of 90%. The reversible operation is detailed later.

The brake not shown is an electrically activated mechanical brake here, equipped with friction linings. It is mounted before the electric motor 201. In other words, we have the following configuration: the brake is connected to the electric motor 201 which is connected to the speed reducer 202 which is itself connected to the cog 203.

As a variant, the brake may also be integrated into the electric motor 200.

Such an assembly formed by the two actuators 200 and the toothed wheel 204 can be implemented in the transfer system of FIG. 1 at the location of each of the assemblies constituted by the electrical actuators 11, 12, 13 engaged with a toothed wheel.

As clearly illustrated in FIGS. 3*a* and 3*b*, the coupling system 32 is equipped for the link with the target duct 33 of a coupler 31 equipped with four electrical actuators 31*a*, 31*b*, 31*c* and 31*d*. The objective is to provide optimum clamping at the location of the link. The coupler 31 comprises to that end four clamping jaws 404 enabling the fastening to the target duct 33 to be provided.

As illustrated in FIG. 3*b*, the four clamping jaws 404 are actuated by means of four electrical actuators 31*a*, 31*b*, 31*c* and 31*d*. An alternative embodiment would be to employ one electrical actuator to actuate the four clamping jaws 404.

Each electrical actuator 31*a*, 31*b*, 31*c* and 31*d*, comprising a speed reducer 400 and an electric motor 401, is linked to a drive system and a position sensor. The position sensor, not shown, may be an encoder.

The drive system comprises a drive screw 402 and a drive nut 403.

To the technical features of the electrical actuator 31*a*, 31*b*, 31*c* and 31*d* cited above is to be added a measurement of clamping torque or force by means of a drive.

Figure 3C:
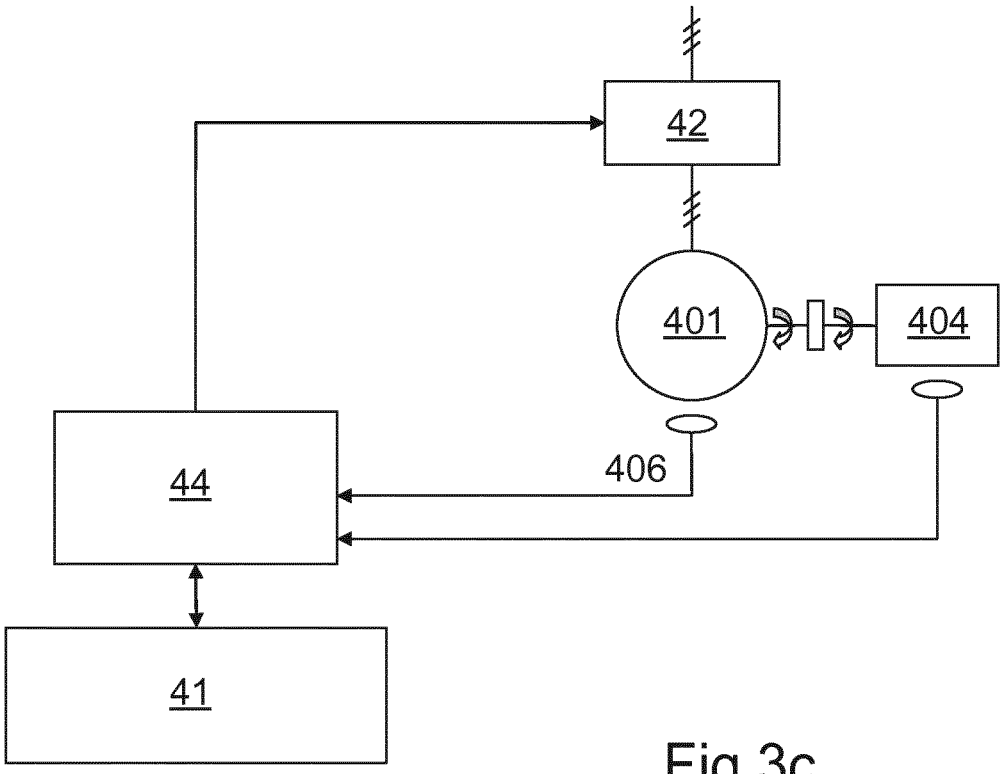
FIG. 3*c* illustrates an operating diagram of the checking of the closing of the coupler when the checking is carried out using a clamping force sensor.
Figure 3D:
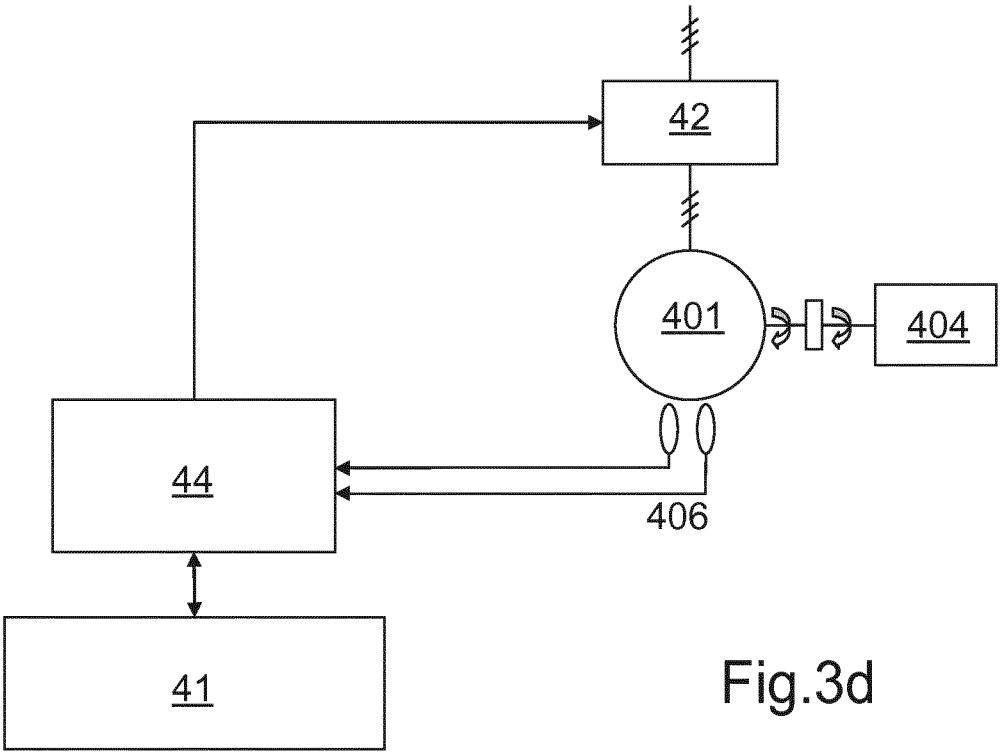
FIG. 3*d* is an operating diagram of the checking of the closing of the coupler when the checking is carried out using a clamping torque sensor.

With reference to FIGS. 3*c* and 3*d*, the clamping jaw 404 is actuated by the electric motor 401 which generates a motor torque. The motor torque is transmitted to the clamping jaw 404 via the speed reducer and the drive system.

In practice the position sensor indicates the linear translation of the drive system. Advantageously the position sensor may also be a sensor of the number of revolutions of the electric motor 401.

For the purpose of verifying the clamping torque of the clamping jaw 404, an indirect measurement of the clamping torque is performed by a measurement of the current consumed.

In a first alternative of which the principle of operation is illustrated in FIG. 3*c*, the force sensor is a sensor of the current consumed by the electric motor 401.

In a second alternative of which the principle of operation is illustrated in FIG. 3*d*, the force sensor is a sensor of the current consumed to generate the rotational torque.

As illustrated in FIG. 3*c*, the electric motor 401 generates a motor torque which drives the clamping of the clamping jaw 404. More specifically, when the electric motor 401 generates a motor torque, the electric motor 401 drives the drive screw 402. The position sensor sends a measured value of the position to the API 44. The API 44 communicates the measured value of the position to the command console 41. The operator may issue a setting value which is sent to the API 44. According to the setting value, the measured value and the value of the indirectly measured clamping torque of the clamping jaw 404, the API 44 sends a setting to the electric motor via the control cabinet 42.

The principle of verification of the clamping illustrated in FIG. 3*d* is the same as presented earlier. The measurement of the clamping torque value has been replaced by a measurement of the rotational torque at the electric motor 401. This rotational torque is measured by means of a measurement of the current consumed through use of a drive.

In a variant of operation, the setting value may automatically be sent by the API 44 to the control cabinet 42.

In all cases, the objective of the clamping verification is to obtain an optimum and uniform clamping force at the clamping jaws 404.

Figure 4:
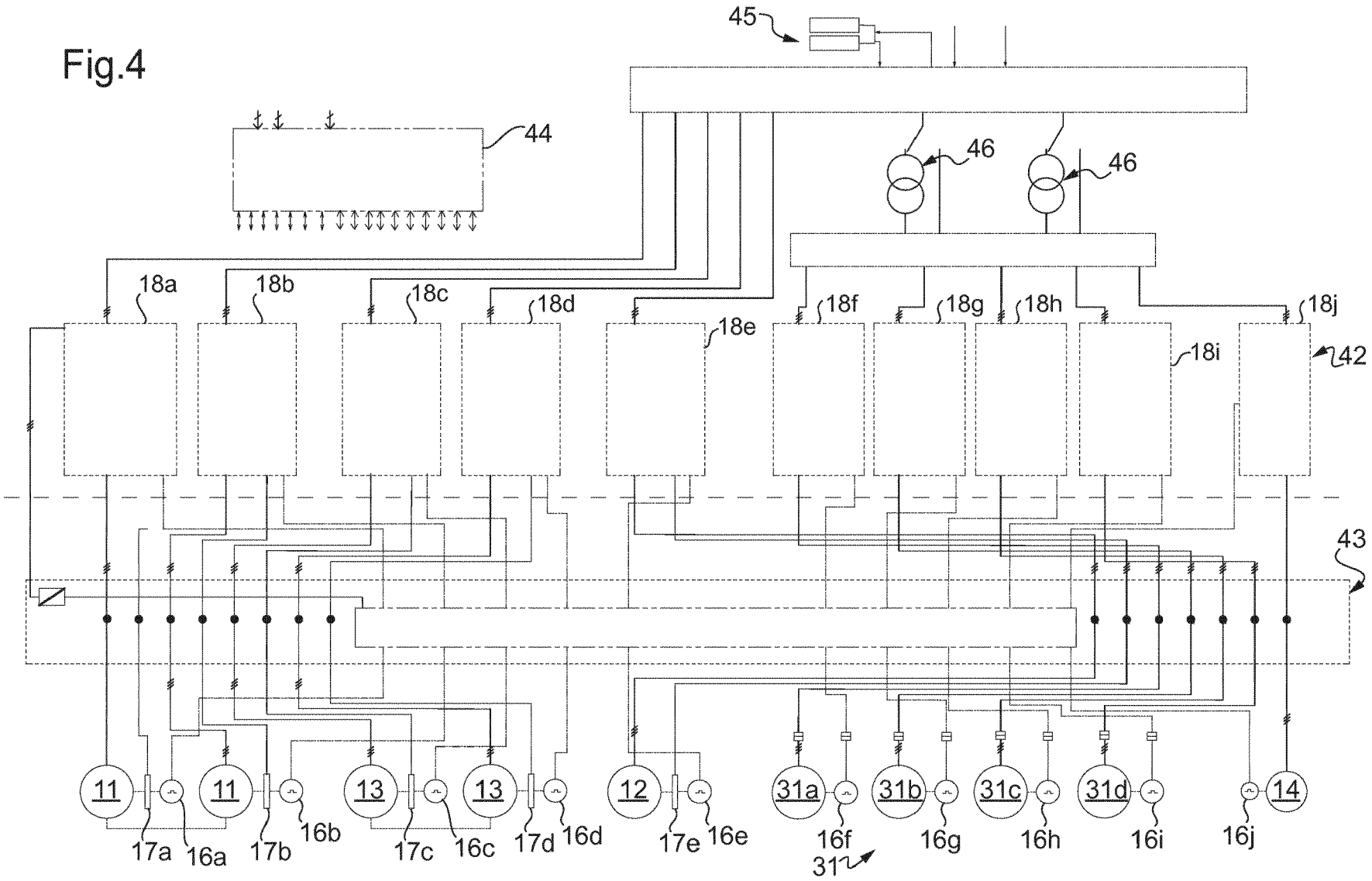
FIG. 4 is a diagram of an electrical architecture variant according to the invention.

According to another embodiment of the invention presented in FIG. 4, an electrical diagram of the whole of the system is illustrated.

The electrical components are distributed into two zones, which are separated by dashes in the diagram of FIG. 4.

The electrical actuators 11, 12, 13, 14, 31*a* to 31*d* are present in a working zone.

The maneuvering electrical actuators 11, 12, 13 comprise in particular a brake 17*a* to 17*e*.

The electrical actuators 31*a*, 31*b*, 31*c*, 31*d* comprise in particular an emergency release 20*a*, 20*b*, 20*c* and 20*d*. The emergency release 20*a*, 20*b*, 20*c* and 20*d* makes it possible to electrically disconnect the motors 31*a*, 31*b*, 31*c* and 31*d* when the emergency release 14' is actuated.

All the electrical actuators 11, 12, 13, 14, 31 here comprise an encoder 16*a*-16*j*. The encoders 16*a*-16*j* make it possible to determine in real time the position of the mechanical structure 2, and more specifically of the inner tube 22 and of the outer tube 23 as well as of the clamping jaws 404 and of the emergency release system 14. Based on this information, it will in particular be possible to deduce therefrom the position of the end of the mechanical structure 2 which forms the link with the target duct 33.

The information coming from the different coders 16*a*-16*e* can also make it possible to fulfill the function of a PMS, that is to say "Position Monitoring System" and thus the detection of the entry of the mechanical structure 2 into the critical zones of the work envelope and thereby to trigger alarms. The information coming from the different encoders 16*a*-16*e* thus also makes it possible to launch automatically the sequences for emergency release of the ERS via the electrical actuator 14.

More particularly with regard to the electrical actuators 31*a*, 31*b*, 31*c*, 31*d*, the presence of an encoder 16*f*-16*i* on each electrical actuator presents advantages both on making a connection and on making a disconnection.

On making a connection with the ground, on a vehicle or water craft in particular a ship 3, the coupler 31 will couple in three steps.

In the first step, the coupler 31 must overcome the friction torque of the different components of the coupler 31, in particular of the clamping jaws 404. In the first step, the necessary motor torque is high but the speed is low.

The second step corresponds to an approach phase of the different components of the coupler 31. In the second step, the motor torque is low but the speed is high.

The third step corresponds to a clamping phase. In the third step, the motor torque is high but the speed is low.

One encoder 16*f*-16*i* per electrical actuator 31*a*, 31*b*, 31*c*, 31*d* furthermore makes it possible to know the position of the different components of the coupler 31 and to adapt the motor torque and the speed delivered by the API 44.

One encoder 16*f*-16*i* per electrical actuator 31*a*, 31*b*, 31*c*, 31*d* also makes it possible to send information on the connected or unconnected state of the coupler 31 and to ensure optimum and uniform locking at each of the clamping jaws 404 based on the current consumption information read at each encoder 16*f*-16*i*.

On making a disconnection with the ground, on a vehicle or water craft in particular a ship 3, the coupler 31 will detach in three steps.

In the first step, the coupler 31 must overcome the friction torque of the different connected components of the coupler 31, in particular of the clamping jaws 404.

In the first step, the necessary motor torque is high but the speed is low.

The second step corresponds to a retraction phase of the different components of the coupler 31. In the second step, the motor torque is low but the speed is high.

The third step corresponds to a phase of placing in abutment. In the third step, the motor torque is high but the speed is low.

The present invention has the advantage of the installation of an encoder on each electrical actuator 31*a*, 31*b*, 31*c*, 31*d*.

One encoder 16*f*-16*i* per electrical actuator 31*a*, 31*b*, 31*c*, 31*d* makes it possible to know the position of the different components of the coupler 31 and to adapt the motor torque and the speed delivered by the API 44.

One encoder 16*f*-16*i* per electrical actuator 31*a*, 31*b*, 31*c*, 31*d* also makes it possible to send the information on the connected or unconnected state of the coupler 31.

Furthermore, thanks to the reading in real time of the position of the clamping jaws 404 via the encoders 16*f*-16*i*, any risk of leakage at the coupling zone due to an inadvertent opening of one or several clamping jaws 404 at the time of a loading or unloading operation will be detected. The safety level is thus increased.

Furthermore, to return to the electrical diagram of FIG. 4, each electrical actuator 31*a*, 31*b*, 31*c*, 31*d* is electrically connected to the control cabinet 42 via the disconnectors 20*a* to 20*d*.

Furthermore, each maneuvering electrical actuator 11, 12, 13 comprises a brake. These brakes 17*a*-17*e* make it possible to fix the position of the corresponding actuator when it is not used during the manipulation of the loading arm.

The brakes 17*a*-17*e* also serve as parking brake to fix the arm in resting position. The brakes thus make it possible to provide safety for the equipment or persons situated around the loading arm.

All the electrical actuators 11, 12, 13,14, 31*a*, 31*b*, 31*c*, 31*d* are electrically connected and also connected by a fieldbus of EtherCAT type to the control cabinet 42. Each electrical actuator 11, 12, 13,14, 31*a*, 31*b*, 31*c*, 31*d* is moreover linked to a specific control means 18*a*-18*j*. The control means 18*a*-18*j* comprise the electrical equipment necessary to control the electrical actuators, such as drives and filters.

The control means 18*f*-18*j* are connected to the electrical supply 45 via an isolating transformer 46 detailed later.

In the embodiment of FIG. 4, the control cabinet 42 contains control means for the management of the encoders 16*a*-16*j*. As for the control means mentioned previously, these are located in the safety zone.

To manage the encoders 16*a*-16*j*, the control cabinet 42 is positioned directly in the working zone but only serves as a relay. For reasons of reliability of signal transmission, the control cabinet 42 cannot be placed in a secure area. However, the API 44 is positioned in a secure area. Thus, the space occupied in a secure area is reduced and the conditions of confinement of the electrical components are less important.

Different modes of operation of the mechanical structure are possible, in particular a driving mode, a fixed mode and a freewheel mode.

In the driving mode, movements of the mechanical structure are provided by the electrical actuators 11, 12, 13,14, 31*a*, 31*b*, 31*c*, 31*d*. The driving mode is used at the time of the connection, of the disconnection and of the maintenance.

In the fixed mode, the maneuvering electrical actuators 11, 12, 13 are fixed via the mechanical brake 17*a*-17*d* integrated into the actuator.

In the freewheel mode, the mechanical structure, once connected, follows the movements of the ship 3 during the loading and the unloading. Therefore, for the freewheel mode the maneuvering electrical actuators 11, 12, 13 follow the movements which are imposed upon them while minimizing the resisting torques and/or resisting forces by virtue of the reversible reducers. In this freewheel mode, the loading arm directly applies a torque to the actuating shaft of each actuator, making it turn in reverse rotational direction to that observed during the connection phase.

This freewheel mode can also apply in emergency release mode. The brakes must be unclamped in the case of this freewheel mode.

Figure 5:
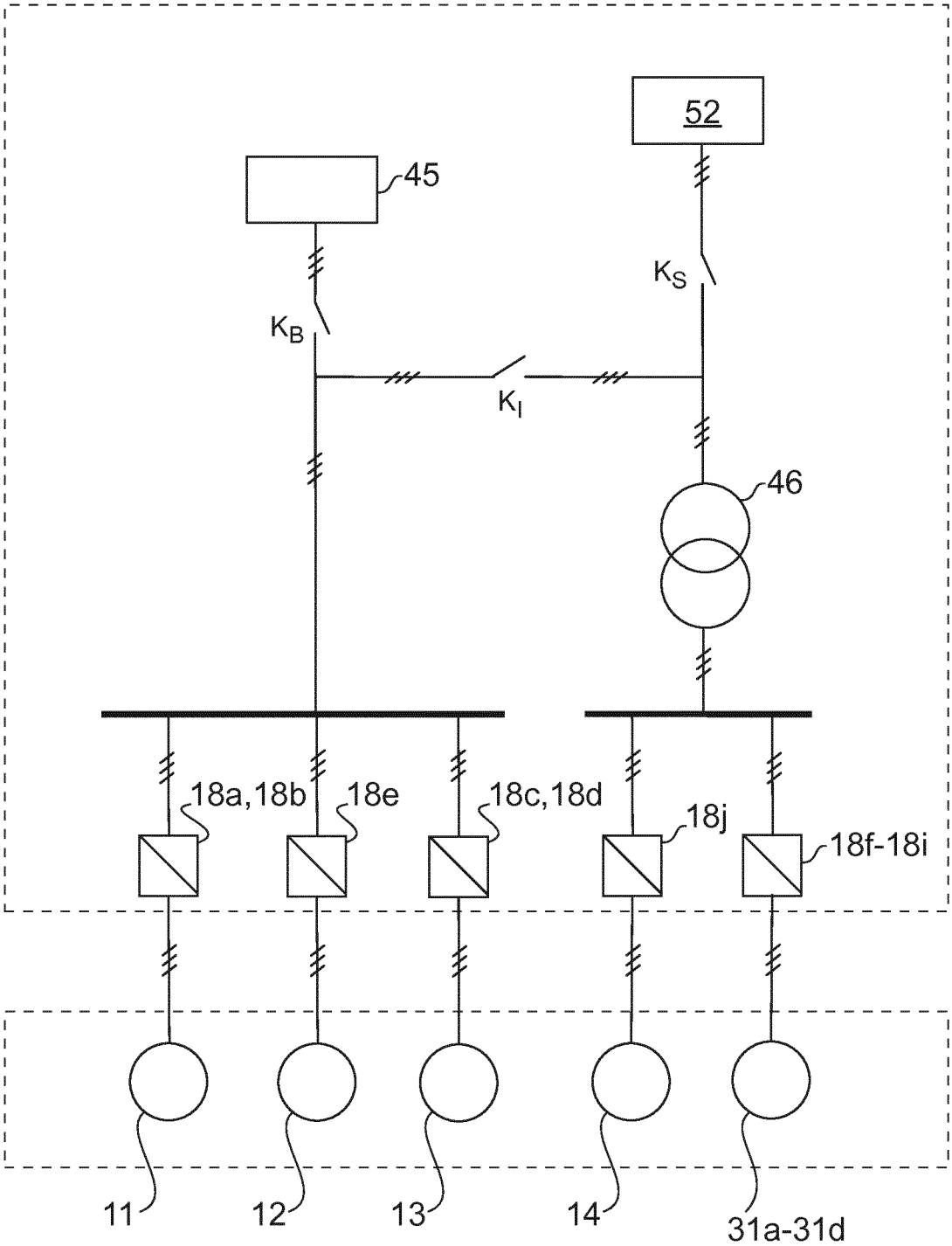
FIG. 5 illustrates an synoptic electrical diagram of energy recovery.

The freewheel mode, in particular, also makes it possible to introduce the principle of energy recovery. FIG. 5 illustrates an electrical diagram of the energy recovery principle, in which the electric motors of the actuators 11, 12, 13 can be transformed into current generators for this purpose.

FIG. 5 presents the different possibilities of electrical supply of the electrical actuators 11, 12, 13,14, 31*a*, 31*b*, 31*c*, 31*d*.

In driving mode, the electrical supply can be provided either by the main supply 52, or by the emergency power supply 45.

When the electrical supply from the emergency power supply 45 operates, the switches Kb and KI are closed and the switch Ks is open.

When the supply from the emergency power supply 45 does not operate, the switches KI and Ks are closed and the switch Kb is open. In other words, the supply is provided by the main electrical supply 52.

When the emergency power supply 45 recovers the electrical energy from the maneuvering electrical actuators 11, 12, 13, the switches KI and Ks are open and the switch Kb is closed.

As a variant, the current generated may also be fed back into the main electrical supply 52, provided the electricity conversion operations required in the field of electricity are carried out.

When the motor used is a brushless motor, the recovery of energy is possible in freewheel or emergency release mode, whereas when the motor is an asynchronous motor, the energy recovery is only possible in emergency release mode. As a matter of fact, in freewheel mode, the actuators are not supplied.

In practice, one or other of these motors operates to generate current according to conventional principles.

As the speed reducer is reversible, each non-actuated movement of the mechanical structure enables electric current to be generated and to supply the energy recovering device by a rotation of the upper actuating shaft at the synchronous speed.

More generally, the following points further merit being noted on the subject of the embodiments described above and possible variants thereof. The fluid transfer system described with reference to the drawings is an articulated arm of which the inner and outer tubes are self-supporting. As a variant, these may be supported by a support structure. In more general terms, it may be a type of fluid transfer system of the same kind as those described in the patent applications mentioned above.

In the case of the embodiments described above, the reversible reducer is engaged with a toothed wheel rotationally coupled to the transfer line or is coupled to a drive system of the latter. It is more specifically fastened to a swivel joint of a set of bends and swivel joints, typically connecting two segments of pipe of the transfer line or to the pantograph system serving for the rotational driving of a section of pipe of the transfer line. When a support structure is implemented, the toothed wheel can, of course, be coupled to that support structure.

The reversible reducer described above with reference to the drawings is a reducer with an epicyclic gear train. As a variant, it may be a reducer with parallel shafts or a reducer with perpendicular shafts, provided they are reversible. As a variant, the reversible reducer may also be coupled to the transfer line or to a support structure thereof, via a chain, a toothed belt or a movement transmission system comprising at least one pulley, a cable wound on the latter or these latter, and at least one reversible linear actuator linked to the cable and engaged with one of the actuators with a reversible reducer. The pulley may, for example, be a pulley of the pantograph system with pulleys and cable described with reference to the drawings, in which case the toothed wheel coupled to the pulley would be replaced by such a transmission system.

By reversible linear actuator here is meant a non-hydraulic or non-electrical actuator. In practice, with the reversible reducer actuator it forms an electrical jack. The linear actuator per se may for example be a ball or roller screw jack.

The motor and reducer may also take the form of a geared motor. Moreover, the electric motor may be synchronous or asynchronous.

In the case of the embodiments described above with reference to the drawings, the braking means take the form of a mechanical brake integrated into the actuator. As a variant, these brake means may, for example, be adapted to perform the braking by means of the motor itself and position feedback.

The coupling system described above comprises a coupler articulated to the end of the transfer line with three degrees of rotational freedom, by virtue of the swivel joints employed. In a possible case, at least one of the three degrees of rotational freedom may be controlled by an electrical actuator. In practice, starting from the transfer line, this is the second of the three degrees of rotational freedom.

Generally, the coupler may be a coupler with manual or electrical clamping onto the target duct and comprises, in the case of electrical clamping, at least one electrical actuator adapted to drive an actuating system of one or more clamping jaws of the coupler.

As indicated above, the coupling system is equipped with an emergency release system comprising two valves which are juxtaposed using a collar of which the opening is controlled by at least one electrical actuator, said at least one electrical actuator also controlling at least the closing of the valves. In practice, this control may for example be obtained by the movement in translation of a rod, such as described for example in patent application WO2007/017559.

As also described above, the electrical actuator or actuators of the coupling system are advantageously connected to a source of electrical energy supply via an insulating transformer. As a variant, this electrical actuator or these electrical actuators may have electrical insulating members between the motor shaft and the speed reducer and on the motor. Furthermore, the coupling system preferably comprises, in addition to the aforementioned means, an electrically insulating barrier of mechanical nature on a swivel joint thereof. In practice, this is the second joint out of three that are referred to above.

A certain number of sensors and measuring means have been described above with reference to the drawings. More generally, the following provisions may be implemented.

- the electrical actuators for controlling the movement of the transfer line may be equipped with sensors suitable for enabling the configuration of the transfer line to be determined; and/or
- the or each electrical actuator of the coupler with electrical clamping may be provided with a measuring means suitable for enabling knowledge of the position of the assembly formed by a clamping jaw and its actuating system to be obtained; and/or
- the transfer system comprises several electrical coupler actuators and a drive is associated with each electrical actuator of the coupler and comprises a means for measuring the current consumed by the actuator so as to be able to provide, based on information on current consumption, identical clamping at each of the associated jaws and to enable fluid-tight connection of the coupler to the target duct, it also being possible for the drive to comprise a measuring means enabling it to be known whether or not the coupler is in clamped position on the target duct, the adaptation of the speed and/or the torque of the assembly formed by the clamping jaw and its actuating system according to its position, or the drive may also comprises means making it possible to adapt the speed and/or the torque of the electrical actuator associated with the emergency release system according to the position of the valves of that system; and/or
- the electrical actuator of the emergency release system may be provided with a measuring means suitable for enabling knowledge to be obtained of the position of the valves of the emergency release system.

The measuring means provided on the actuators are preferably encoders. These sensors and/or measuring means prove to be particularly useful in the context of a connection procedure that is automatic or semi-automatic (the operator is assisted in the connection procedure). In the context of a manual connection, it is henceforth possible in particular to provide sensors, such as inclinometers, in order to have information as feedback on the subject of the configuration of the transfer line.

In the case of the embodiments described with reference to the drawings, the electric motor of one or more of the electrical actuators for controlling the movement of the transfer line in space is a motor of which the operation is able to be transformed into current generator mode when an actuating torque is directly applied to the actuating shaft of the corresponding electrical actuator or actuators.

As a variant, the actuating shaft of one or more electrical actuators for controlling the movement of the transfer line in space may be associated with a current generator to produce electricity from an actuating torque applied directly to it.

Thus, generally, one or more electrical actuators for controlling the movement of the transfer line in space may be associated with means for generating current to produce electricity.

The current generated may be recovered in a battery or in a reversible emergency power supply, or may even be fed back into the circuit or have a consumer be found for it, such as a braking resistance.

More generally too, and according to a provision which is original as such, the transfer system may comprise first control means of the electrical actuators associated with the transfer line, situated at a distance from that transfer line and second control means of the one or more measuring means associated with the electrical actuators, the second control means being installed in an explosion-resistant envelope near the transfer line.

These provisions have been described above for the particular embodiment of FIG. 4. It should be noted, in this connection, that they may be implemented without it being needed to implement specific electrical actuators such as described above, but may be implemented with conventional electrical actuators.

Moreover, the measuring means defined above may, in that case, also be replaced by one or several measuring means of any type, that are usually associated with electrical actuators.

Numerous other variants are possible according to circumstances, and in this connection it is to be noted that that the invention is not limited to the examples represented and described.

The invention claimed is:

1. A fluid transfer system for the transfer of fluid from a storage position to a target duct or from the target duct to the storage position, the fluid transfer system comprising:

a tubular fluid transfer line comprising at one of its ends a coupling system adapted to be connected to the target duct for the transfer of fluid; and a plurality of first electrical actuators which are operable to control movement of the fluid transfer line in space, each first electrical actuator comprising:

an actuating shaft which is coupled to the transfer line;

an electric motor having an output shaft;

a speed reducer having an input which is connected to the output shaft and an output which is connected to the actuating shaft, the actuating shaft being rotationally driven by the output shaft by means of the speed reducer, the speed reducer being reversible such that a torque applied to the input will rotate the output and a torque applied to the output will rotate the input so as to enable the actuating shaft to turn when an actuating torque from the transfer line is directly applied to the actuating shaft; and braking means for locking the electrical actuator in position when the electrical actuator is not used for moving the fluid transfer line in space;

wherein the braking means comprises an electrically activated mechanical brake.

2. The fluid transfer system according to claim 1, wherein the coupling system comprises:

a coupler which includes a number of clamping jaws;

an actuating system for the clamping jaws, the actuating system being driven by at least one second electrical actuator which comprises:

an actuating shaft which is coupled to an actuator for the clamping jaws;

an electric motor having an output shaft; and a speed reducer which is connected between the output shaft and the actuating shaft, the actuating shaft being rotationally driven by the output shaft by means of the speed reducer;

an emergency release system comprising two valves which are juxtaposed using a collar, wherein the opening of the collar is controlled by at least one third electrical actuator;

wherein the transfer system comprises (i) a means for measuring the current consumed by the at least one second electrical actuator so as to be able to provide, based on information on current consumption, identical clamping at each of the associated jaws and to enable fluid-tight connection of the coupler to the target duct, (ii) a measuring means enabling it to be known whether or not the coupler is in clamped position on the target duct, (iii) a measuring means enabling the adaptation of the speed and/or the torque of the assembly formed by the clamping jaw and its actuating system according to its position, or (iv) a measuring means making it possible to adapt the speed and/or the torque of the at least one third electrical actuator associated with the emergency release system according to the position of the valves of that system.

3. The fluid transfer system according to claim 1, wherein the coupling system comprises a coupler which includes a number of clamping jaws and an actuating system for the clamping jaws, said actuating system being driven by at least one second electric actuator which comprises:

an actuating shaft which is coupled to the actuating system for the clamping jaws;

an electric motor having an output shaft; and a speed reducer which is connected between the output shaft and the actuating shaft, the actuating shaft being rotationally driven by the output shaft by means of the speed reducer.

4. The fluid transfer system according to claim 3, wherein said at least one second electrical actuator comprises measuring means for providing information on the position of the clamping jaws or the actuating system.

5. A fluid transfer system for the transfer of fluid from a storage position to a target duct or from the target duct to the storage position, the fluid transfer system comprising:

a tubular fluid transfer line comprising at one of its ends a coupling system adapted to be connected to the target duct for the transfer of fluid; and a plurality of first electrical actuators which are operable to control movement of the fluid transfer line in space, each first electrical actuator comprising:

an actuating shaft which is coupled to the transfer line;

an electric motor having an output shaft; and a speed reducer having an input which is connected to the output shaft and an output which is connected to the actuating shaft, the actuating shaft being rotationally driven by the output shaft by means of the speed reducer, the speed reducer being reversible such that a torque applied to the input will rotate the output and a torque applied to the output will rotate the input so as to enable the actuating shaft to turn when an actuating torque from the transfer line is directly applied to the actuating shaft;

wherein the motor is configured to operate in conjunction with position feedback to lock the electrical actuator in position when the electrical actuator is not used for moving the fluid transfer line in space.

* * * * *